US006224416B1

(12) United States Patent
Nagai

(10) Patent No.: US 6,224,416 B1
(45) Date of Patent: May 1, 2001

(54) INSULATOR-DISPLACEMENT TYPE CONNECTOR

(75) Inventor: Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/628,308

(22) Filed: Jul. 28, 2000

(30) Foreign Application Priority Data

Jul. 30, 1999 (JP) ..... 11-217136

(51) Int. Cl.[7] ..... H01R 4/24
(52) U.S. Cl. ..... 439/400; 439/405
(58) Field of Search ..... 439/400, 404, 439/417, 395, 375, 465, 405, 398

(56) References Cited

U.S. PATENT DOCUMENTS 4,435,035 3/1984 Berry et al. .
5,123,859 * 6/1992 Davis et al. ..... 439/405
5,895,285 * 4/1999 Okabe ..... 439/400
5,980,303 * 11/1999 Lee et al. ..... 439/405

* cited by examiner

*Primary Examiner*—Brian Sircus
*Assistant Examiner*—Phuong K T Dinh
(74) *Attorney, Agent, or Firm*—Finnegan, Henderson, Farabow, Garrett & Dunner, L.L.P.

(57) ABSTRACT

A connector housing has a terminal accommodating chamber for a terminal and has an upper wall defining an opening part for insulator displacement. The connector housing has a flexible engagement piece at a front edge of the opening part. The connector housing has a first locking piece at a rear end thereof. A cover is assembled to the connector housing for closing the opening part. The cover has a second locking piece at a rear end thereof. The cover has an engagement projection at a front end thereof. When the cover is pushed down toward the opening part, the flexible engagement piece is locked with the engagement projection and the first locking piece is locked with the second locking piece.

6 Claims, 2 Drawing Sheets

INSULATOR-DISPLACEMENT TYPE CONNECTOR

BACKGROUND OF THE INVENTION

The present invention relates to an insulator-displacement type connector.

There has been disclosed in U.S. Pat. No. 4,435,035 an insulator-displacement type connector of such a structure. When assembling the connector, an insulator displacing terminal is set in a terminal accommodation chamber of a connector housing, and an insulated wire is pressed to the terminal, using an opening part of the housing. Then, an engagement projection at a front end of the cover is inserted under a front edge of the opening part from rearward, and a rear end locking part is locked with a rear end licking part of the housing from rearward, thus assembling the cover to the housing.

SUMMARY OF THE INVENTION

It therefore is an object of the present invention to provide an insulator-displacement type connector in which a series from pressure-fitting connection to assembly of a cover is automated.

To achieve the object, the invention provides an insulator-displacement type connector. The connector has a connector housing which has a terminal accommodating chamber for a terminal and has an upper wall defining an opening part for insulator displacement. The connector housing has a flexible engagement piece at a front edge of the opening part. The connector housing has a first locking piece at a rear end thereof. The connector has a cover which is assembled to the connector housing for closing the opening part. The cover has a second locking piece at a rear end thereof. The cover has an engagement projection at a front end thereof. When the cover is pushed down toward the opening part, the flexible engagement piece is locked with the engagement projection and the first locking piece is locked with the second locking piece.

Preferably, the first locking piece is provided on a first side of the connector housing and the second locking piece is provided on a second side of the cover.

A second aspect of the invention provides an insulator-displacement type connector. The connector has a connector housing defining a terminal accommodation chamber for an insulator displacing terminal. The connector housing has a wall covering the terminal accommodation chamber. The wall defines an opening corresponding to an insulator displacing part of the terminal. The connector has a first lug which projects from the wall toward the opening and has a first distal end. The connector has a cover to be pushed down normally to the wall of the connector housing for closing the opening of the wall. The connector has a second lug which projects from the cover for locking with the first lug and has a second distal end overlapping with the first distal end of the first lug.

Preferably, the first distal end of the first lug has a first inclined part relative to the second distal end of the second lug.

Preferably, the second end of the second lug has a second inclined part relative to the first distal end of the first lug.

A third aspect of the invention provides a manufacturing method for an insulator-displacement connector. The method has a step of pressing an insulated wire to an insulator displacing terminal in a terminal chamber of a connector housing, using a opening defined by the wall covering the terminal chamber. The method has a step of pushing down a cover toward the opening normally to the wall for a second lug to pass over a first lug to be locked with the second lug, the first lug projecting from the wall toward the opening, the second lug projecting from the cover.

According to the invention, when assembling the insulator-displacement type connector, an insulated wire is pressed to an insulator displacing terminal for contacting a conductor of the wire with the terminal, and a cover is pushed down toward an opening part from above as well as the wire. Then, an engagement projection at a front end of the cover is brought in contact with a flexible engagement piece. The engagement projection passes over the engagement piece with the engagement piece being flexed, thus to be locked with the engagement piece. At the same time, the second locking piece is locked with the first locking piece. Therefore, the cover is pushed down toward the opening part from above, so that a front end and a rear end of the cover are locked simultaneously.

BRIEF DESCRIPTION OF THE ACCOMPANYING DRAWINGS

These and other features, aspects, and advantage of the present invention will become better under stood with regard to the following description, appended claims, and accompanying drawings where:

DETAILED DESCRIPTION OF THE PREFERRED EMBODIMENTS

An embodiment of the invention will be explained with reference to drawings.

Figure 1:
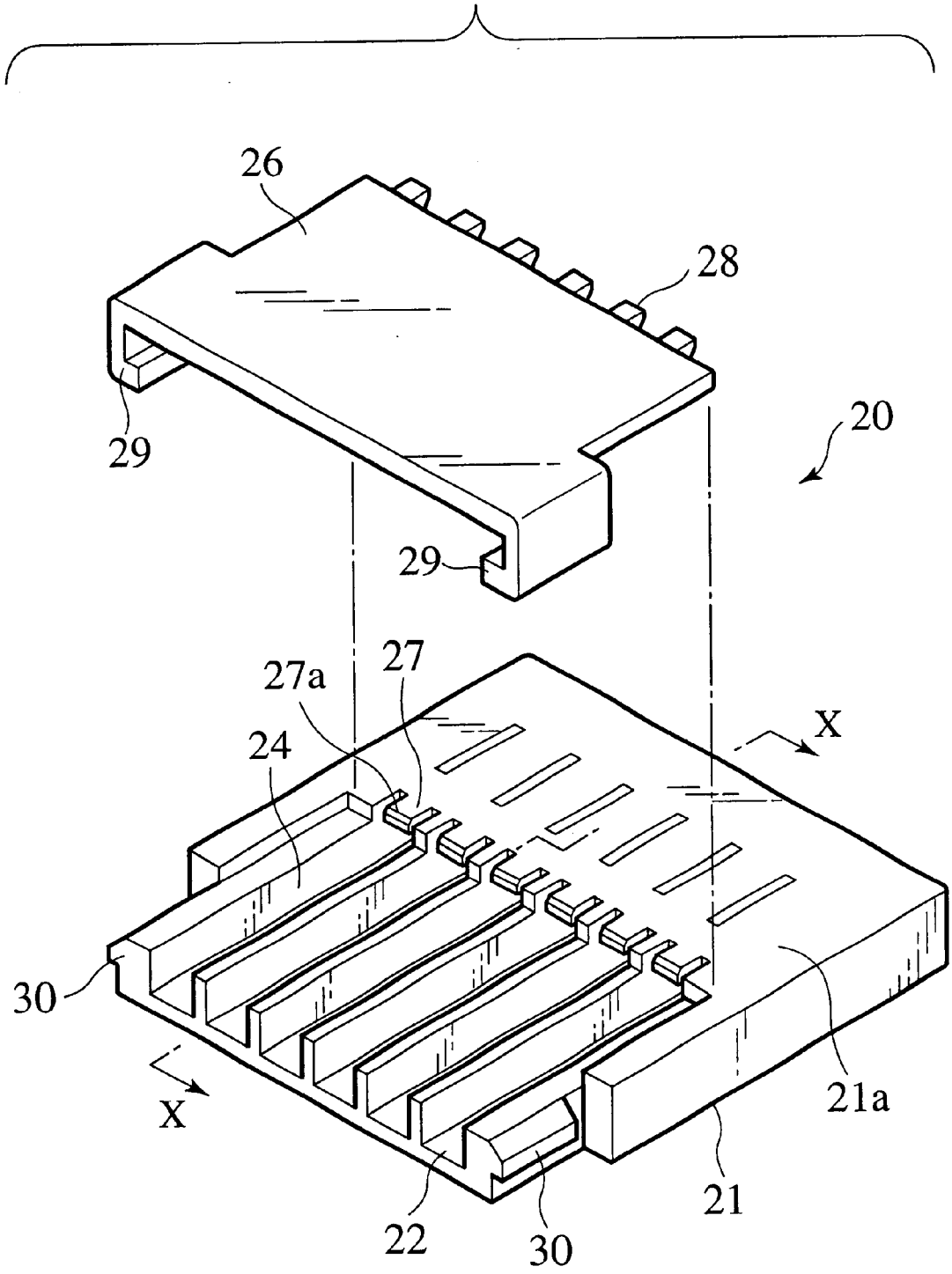
FIG. 1 is an exploded perspective view of an insulator-displacement type connector of an embodiment according to the invention.
Figure 2A:
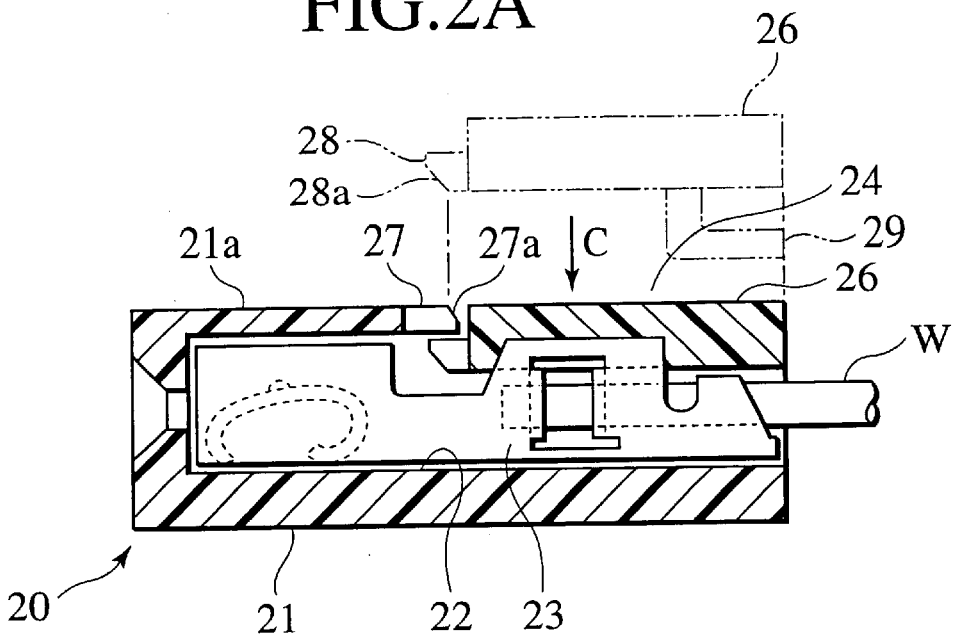
FIG. 2A is a sectional view taken along arrow X—X of FIG. 1.

As shown in FIGS. 1 and 2A, an insulator-displacement type connector 20 has a connector housing 21 made of synthetic resin and a cover 26 made of synthetic resin. In the connector housing 21, a plurality of terminal accommodating chambers 22 for accommodating insulator displacing terminals 23 are provided in left/right direction. On an upper and rear half portion of the connector housing 21, an opening 24 for opening the rear portions of all the terminal accommodating chambers 22 outside and upwardly is provided. The cover 26 is assembled to the connector housing 21 so as to close the opening 24. The terminal 23 has an insulator displacing part for cutting an insulator of an insulated wire W. The insulated wire W is pressed to the insulator displacing part of the terminal for a conductor of the wire to be contacted with the terminal by insulator displacement.

At a front edge portion of the opening 24, a flexible engagement piece 27 disposed for each terminal accommodating chamber 22 is provided. Each flexible engagement piece 27 is a small piece with a rectangular shape provided at a front edge in a reward projecting manner and it is flexed downward. Also, an oblique chamfered portion 27*a* is provided at an upper face leading end edge of each flexible engagement piece 27. Also, rear end locking portions 30 are provided at left and right sides of the rear end of the connector housing 21.

On the other hand, engaging projections 28 engaged with the respective flexible engagement pieces 27 in a flexing manner by pushing down the cover 26 from the above towards the opening 24 of the connector housing 21 and rear end locking portions 29 engaged with the rear end locking portions 30 of the connector housing 21 are respectively provided at the front end portion of the cover 26, and left and right sides of the rear end portion thereof. Here, a chamfered portion 28*a* abutting on the chamfered portion 27*a* of the flexible engagement piece 27 is provided at a lower face leading end edge of the engagement projection 28.

When this insulator-displacement type connector 20 is assembled, first the insulator displacing terminals 23 are set in the terminal accommodating chambers 22 of the connector housing 21, and respective wires W are pressure-fitted to the respective terminals 23 from the above through the opening 24. Next, as shown with arrow C in FIG. 2A, the cover 26 is pushed down towards the opening 24 from the above like the case of the wires W.

Figure 2B:
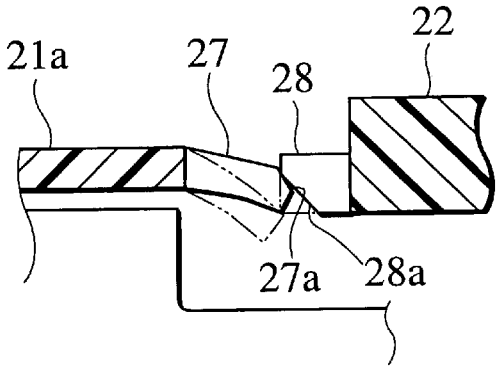
FIG. 2B is a view for explaining operation of a main part in FIG. 2A.

Thereby, the engagement projections 28 positioned at the front end of the cover 26 abut on the flexible engaging pieces 27 positioned at the front edge portion of the opening portion 24. The flexible engagement pieces 27 pass over the engagement projections 28 while the engagement pieces 28 are flexing the flexible engagement pieces 27, as shown in FIG. 2B, so that the flexible engaging pieces 27 are engaged with the engagement projections 28. At this time, the engagement projections 28 enter under the flexible engaging pieces 27 by sliding the chamfered portions 28*a* of the engagement projections 28 and the chamfered portions 27*a* of the flexible engagement pieces 27 with each other. Simultaneously, the locking portions 29 of the cover 26 are engaged with the rear end locking portions 30 of the connector housing 21.

Accordingly, the front end and the rear end of the cover 26 can simultaneously be engaged with the connector housing 21 by only one action such as pushing down the cover 26 from the above towards the opening portion 24 of the connector housing 21, so that the assembling performed by an automatic machine is facilitated. Also, as the rear locking portions 29, 30 are provided at left and right sides, drawing-out of the wires W are not obstructed.

Figure 3:
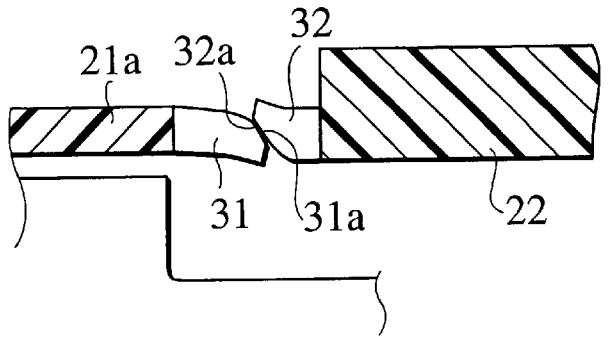
FIG. 3 is a view for explaining operation of a main part of another embodiment according to the invention.

In FIG. 3, an engaging piece 31 and an engagement projection 32 each are flexible, and the engagement projection 32 passes over the engagement piece 31 more easily.

While preferred embodiments of the present invention have been described using specific terms, such description is for illustrative purposes, and it is to be understood that changes and variations may be made without departing from the spirit or scope of the following claims.

What is claimed is:

1. An insulator-displacement type connector comprising:

a connector housing having a terminal accommodating chamber for a terminal, the connector housing having an upper wall defining an opening part for insulator displacement, the connector housing having a flexible engagement piece at a front edge of the opening part, the connector housing having a first locking piece at a rear end thereof; and a cover assembled to the connector housing for closing the opening part, the cover having a second locking piece at a rear end thereof, the cover having an engagement projection at a front end thereof, wherein when the cover is pushed down toward the opening part, the flexible engagement piece is locked with the engagement projection and the first locking piece is locked with the second locking piece.

2. An insulator-displacement type connector according to claim 1, wherein the first locking piece is provided on a first side of the connector housing and the second locking piece is provided on a second side of the cover.

3. An insulator-displacement type connector comprising:

a connector housing defining a terminal accommodation chamber for an insulator displacing terminal, the connector housing having a wall covering the terminal accommodation chamber, the wall defining an opening corresponding to an insulator displacing part of the terminal;

a first lug projecting from the wall toward the opening and having a first distal end;

a cover to be pushed down normally to the wall of the connector housing for closing the opening of the wall; and a second lug projecting from the cover for locking with the first lug, the second lug having a second distal end overlapping with the first distal end of the first lug.

4. An insulator-displacement type connector according to claim 3, wherein the first distal end of the first lug has a first inclined part relative to the second distal end of the second lug.

5. An insulator-displacement type connector according to claim 3, wherein the second end of the second lug has a second inclined part relative to the first distal end of the first lug.

6. A manufacturing method for an insulator-displacement connector comprising the steps of:

pressing an insulated wire to an insulator displacing terminal in a terminal chamber of a connector housing, using an opening defined by a wall covering the terminal chamber; and pushing down a cover toward the opening normally to the wall for a second lug to pass over a first lug to be locked with the second lug, the first lug projecting from the wall toward the opening, the second lug projecting from the cover.

* * * * *